United States Patent [19]

Pasini

[11] Patent Number: 4,941,621

[45] Date of Patent: Jul. 17, 1990

[54] AXIALLY COMPRESSIBLE SPOOL

[75] Inventor: Roberto Pasini, Milan, Italy

[73] Assignee: Tubettificio Europa S.p.A., Milan, Italy

[21] Appl. No.: 365,298

[22] Filed: Jun. 13, 1989

[30] Foreign Application Priority Data

Jun. 30, 1988 [IT] Italy ..... 21164 A/88

[51] Int. Cl.[5] ..... B65H 75/20

[52] U.S. Cl. ..... 242/118.1

[58] Field of Search ..... 242/118.1, 118.11, 118.2, 242/118.3, 118.31, 118.32; 68/189, 198

[56] References Cited

U.S. PATENT DOCUMENTS

| | | | |
|---|---|---|---|
| 3,465,984 | 9/1969 | Tigges et al. | 242/118.11 |
| 3,753,534 | 8/1973 | Ono et al. | 242/118.11 |
| 3,756,532 | 9/1973 | Draper | 242/118.11 |
| 3,827,652 | 8/1974 | Burchette, Jr. | 242/118.11 |
| 3,929,301 | 12/1975 | Frank et al. | 242/118.11 |
| 4,181,274 | 1/1980 | Burchette, Jr. | 242/118.11 |
| 4,270,710 | 6/1981 | Ono | 242/118.11 |
| 4,331,305 | 5/1982 | Marquis et al. | 242/118.11 |
| 4,379,529 | 4/1983 | Nielsen | 242/118.11 |
| 4,454,734 | 6/1984 | Marquis et al. | 242/118.11 X |
| 4,560,116 | 12/1985 | Henning | 242/118.11 |
| 4,789,111 | 12/1988 | Thomas et al. | 242/118.1 |
| 4,823,565 | 4/1989 | Hahm | 242/118.1 |

*Primary Examiner*—Stanley N. Gilreath

*Attorney, Agent, or Firm*—Beveridge, DeGrandi & Weilacher

[57] ABSTRACT

A spool for winding yarns, particularly suited for dyeing and similar operations, which may be compressed in a controlled way. The spool comprises a body having a longitudinal axis and a plurality of coaxially arranged annular members joined by yielding spacing elements; the spacing members extend in a mainly inclined direction with respect to the spool axis, flush to said annular members to define a yarn winding surface. The body furthermore comprises longitudinal stiffening members having breakable stop portions protruding from adjacent annular members to define stop means allowing an axially controlled compression of the body of the spool.

12 Claims, 3 Drawing Sheets

AXIALLY COMPRESSIBLE SPOOL

BACKGROUND OF THE INVENTION

This invention relates to a spool for winding yarns, preferably in thermoplastic material, which may be compressed axially in a controlled way and according to a set value. The spool according to this invention is particularly suited for winding yarns that have to undergo hot and wet treatments, for example dyeing operation in an autoclave.

For yarn winding and treating operations the use of axially compressible spools in plastic material is already known from U.S. Pat. No. 3,465,984 of Sept. 9, 1969. The spools, before yarn dyeing in an autoclave, are slid over tubular support elements in order to be adequately compressed; in this way greater compactness is imparted to the wound yarn and the space taken up is reduced, before treating the yarn with the dye bath.

The use of winding spools known at present, involves various problems still unresolved, or inadequately resolved, which prevent satisfactory treatment of the yarns. In particular, it has been found that the low dimensional stability of the spool during winding of the yarn causes unwanted elongation of the spool which results in the yarn being wound on irregularly.

Another problem resides in the pinching and breaking of the yarn layers close to the spool body at the compression of the spool, with consequent damage to one or more layers of the wound yarn; this not only entails waste of yarn and therefore particularly appreciable economic loss if the yarn is of high quality, it also prevents the yarn from being wound off the spool, after the treatment, using the so-called head-tail system.

A third serious problem associated with the known type of spools, resides in the impossibility of adequately controlling the compression degree and therefore the density of packing of the yarn. In effect, differences have been found in compression and, therefore, in the packing density of the yarn, not only in each spool, but also in different spools on the same support element or on different support elements in an autoclave.

The effect of all this is that in the dyeing plant the treatment liquids are irregularly dispersed throughout the yarn mass or, more generally, the treatment of the yarns is non-homogeneous, resulting in damage to the product and unstable characteristics of the yarn. Effectively, in the case of yarn dyeing, the colouring obtained is non-homogeneous since the varying degree of bundling or packing of the yarn creates preferential passages for the dyeing liquid.

Accordingly, the general object of this invention is to provide an axially compressible yarn-winding spool, capable of avoiding the problems described above.

In particular, a first object of this invention is to provide a compressible spool, which may be controlled to avoid pinching the thread during compression, providing at the same time, before compression, a sufficient structural rigidity and dimensional stability to allow regular winding of the yarn.

A further object of the invention is to provide a spool, as a previously defined, by means of which it is possible to obtain an uniform compression and consequently a constant packing density of the yarn, by controlling to the degree of compressibility of the spool and the packing of the yarn according to a pre-set value.

SUMMARY OF THE INVENTION

The above objects may be achieved with a spool for winding yarn, the spool having an axially compressible body comprising end annular members and a plurality of intermediate ring members, said annular members and said intermediate ring members being coaxially arranged and connected by yielding spacer members defining a winding surface for the yarn, said spacer members being peripherally arranged on the spool body and comprising at least one inclined portion with respect to the longitudinal axis of the spool body; stiffening means being provided between contiguous intermediate ring members, said stiffening means comprising breakable members parallelly arranged to the longitudinal axis of the body of the spool, and stop means between contiguous ring members to limit the axial compression of the spool body, said stop means comprising apposite breakable portions of said stiffening members.

Without prejudicing the innovative principles of this invention, the component parts of the yarn spool may be made with different structures or with different shapes; one particular embodiment will be described below with reference to the appended drawings in which:

DESCRIPTION OF THE INVENTION

Figure 1:
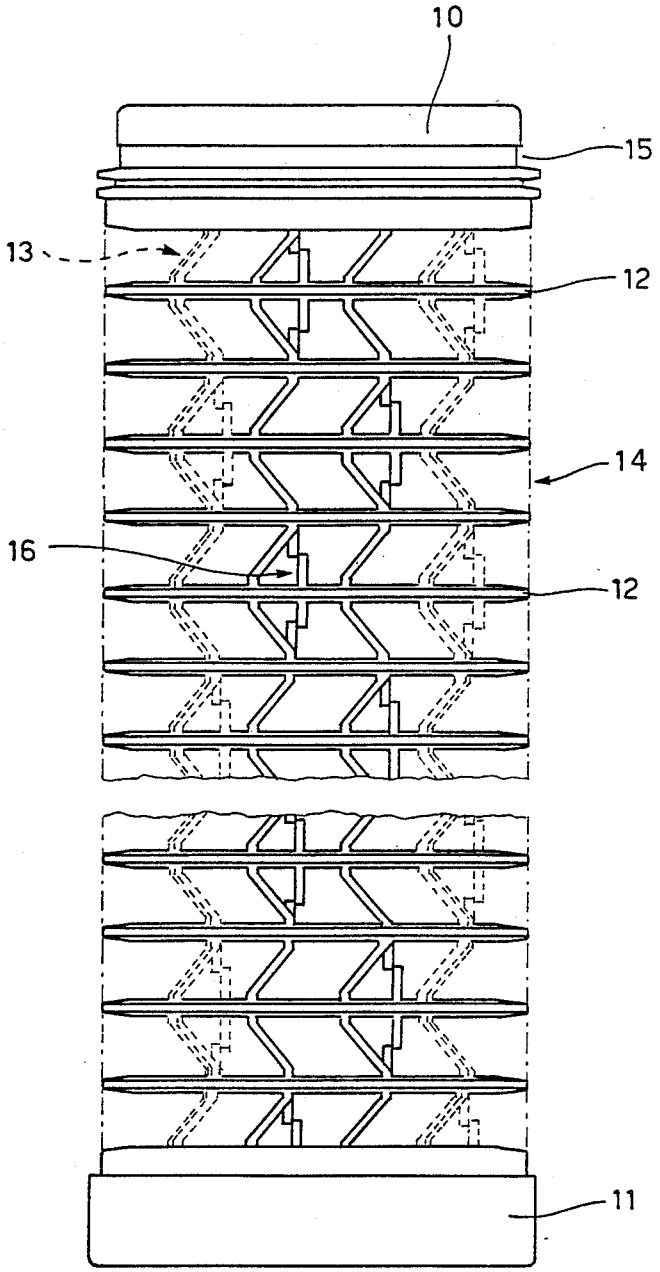
FIG. 1 is a front view of the spool according to the invention.

As shown in FIG. 1, a spool for winding yarn, according to one preferred embodiment, comprises a tubular body having two annular end portions 10 and 11 and a plurality of intermediate annular members 12 spaced apart and coaxially arranged about a longitudinal axis of the tubular body.

The annular portions 10, 11 and the intermediate ring members 12 are connected by a plurality of transverse spacing members 13, only partly shown, which may yield to allow axial compression of the spool body without said spacing members 13 protruding from the yarn-winding surface 14 or interfering with the yarn.

In particular, as shown, the spacing members 13 are inclined laterally or have an inclined portion with respect to the longitudinal axis of the spool body, are aligned in rows and are angularly spaced in a uniform manner from each other; said spacing members 13 in the example under consideration are slanted in two opposite directions with respect to the sides of each intermediate ring member 12.

Figure 2:
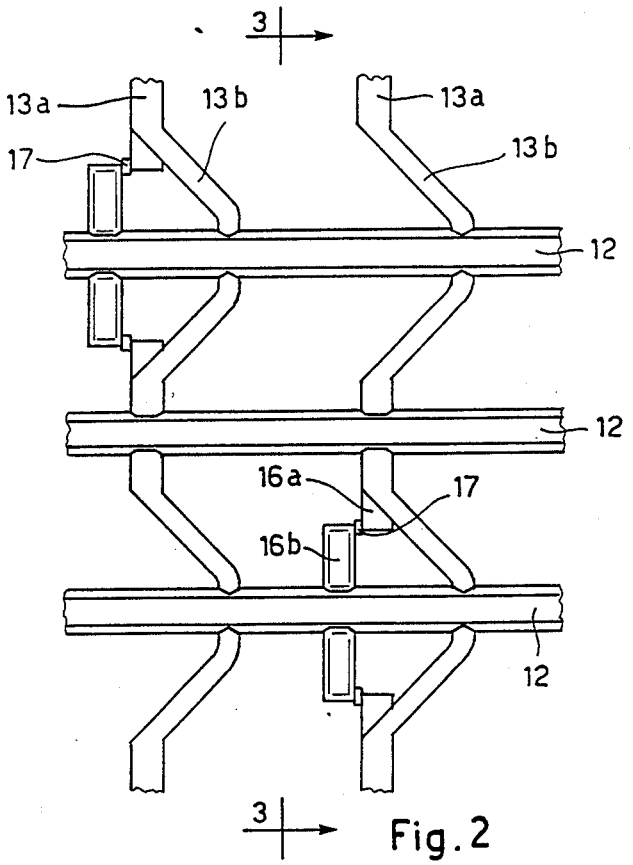
FIG. 2 shows a front view of an enlarged detail of the spool in FIG. 1, in its non-compressed condition.
Figure 3:
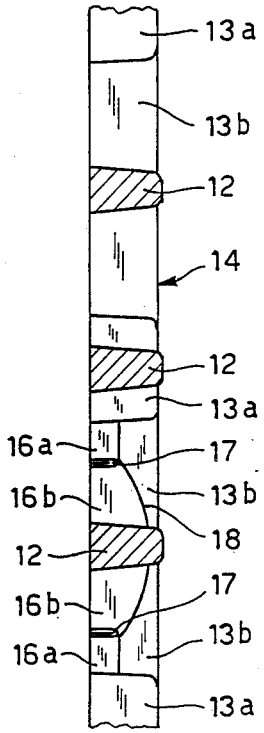
FIG. 3 is a sectional view along the line 3—3 of FIG. 2.

As shown in the enlarged details of FIGS. 2 and 3, each spacing member 13 comprises a thick axial portion 13*a* and a second, thinner, inclined portion 13*b*, the latter being deformable during compression of the spool. Additionally, each spacing member 13 has, in the radial direction of the spool body, a thickness generally equal to that of the intermediate ring member 12 so as to define with these an external surface 14 for winding the yarn. The form of the winding surface, in this specific case, is cylindrical but could also be conic.

The spool can also comprise at one of its annular end portions 10, an area 15 for winding a reserve of yarn; furthermore, the external diameter of the annular portion 10 can correspond to the internal diameter of the annular portion 11 so that several spools can be stacked.

According to this invention, the spool comprises means for providing a required axial rigidity, in the form of transverse elements or bridge pieces 16, positioned between contiguous ring elements 12, so as to increase the dimensional stability of the spool during winding-on of the yarn; the spool also comprises stop means between intermediate ring members 12 allowing a controlled axial compression degree of the spool and an uniformly and constantly distributed compression of the spool throughout the entire length. As a result, the yarn is uniformly and constantly packed with the advantage of enabling a uniform and regular dispersion of the treatment liquids and dye bath through the spool and the yarn wound around it.

Preferably, according to a particular embodiment of the invention, axially stiffening means 16 comprise breakable portions **16*a*, 16*b* defining, during compression, the stop means for the ring members 12** to control the compression degree.

As clearly shown in the drawings, between contiguous ring members 12, are provided stiffening bridge members 16 mainly extending in a longitudinal direction or parallel to the spool's axis, each bridge member 16 comprising an upper portion **16*a* positioned on one side, and a lower portion 16*b* joined to the former at a weakened breaking point 17**.

Figure 4:
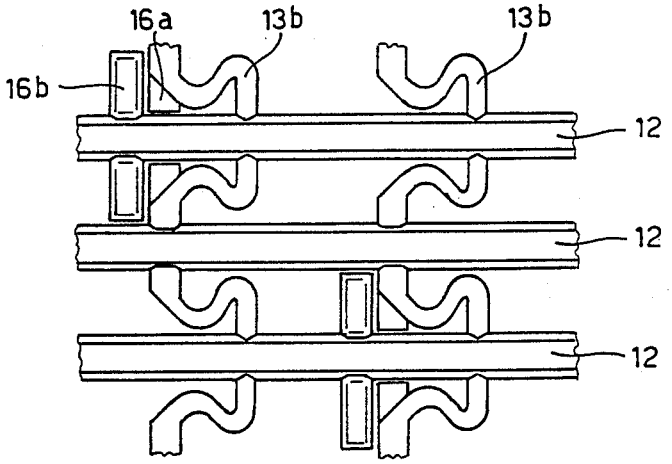
FIG. 4 shows a view similar to FIG. 2 in the compressed condition.

In FIGS. 2 to 4 the upper portion **16*a* is positioned in the same plane as, and as an extension of a portion 13*a* of a respective spacing member 13 so that each stiffening member 16 is placed as close as possible to a spacing member 13** in order to prevent the yarn from being pinched or damaged during spool compression.

With this purpose in view, the stiffening bridge members 16 have a radial thickness less than that of the spacing members 13 so that the outside edge of the bridge members 16 is recessed inwards with respect to the outer surface 14 for winding the yarn.

Preferably, as shown in FIG. 3, in the case where the bridge members 16 define ring stop means for limiting spool compression, the upper portion **16*a* of each bridge member 16 has a constant radial width equal, for example, to half the radial width of the spacing members 13, while the lower portion 16*b* has a diminishing width with the outside edge 18 rounded and curving, from a ring 12, towards the portion 16*a* of the bridge member 16. In this way the curved, recessed length of each bridge member 16, in addition to giving a certain support to the yarn in an intermediate position between two spacing members 13, facilitates any inward sliding of the yarn during spool compression. This prevents the yarn being pinched and therefore damaged, because the bridge members 16 tend to keep the yarn well clear of the spacing members 13** and of their parts that are deformed during compression.

The above can be better understood by referring to FIGS. 2, 3 and 4 of the appended drawings. FIGS. 2 and 3 show the ring members 12, the inter-ring connecting or spacing elements 13 and the stiffening bridge elements 16 in their initial state, when the spool is not yet compressed. As such, the two portions **16*a* and 16*b* of each bridge member 16, which are pointed in opposite directions and are overlapping, are connected to each other at the weakened breaking point 17; the interring connecting or spacing members 13 also have their portion 13*b* in the inclined position and not yet deformed (see FIG. 2). In this state the spool has an essentially cylindrical yarn-winding external surface 14 and an adequate dimensional stability since the bridge members 16** prevent the spool body from being elastically elongated or shortened, or from being deformed by the radially acting force exerted by the yarn during winding.

To achieve axial compression of the spool, the latter is made subject to an axial thrust of calculated value and sufficient to cause breakage of the bridge members 16 at their weakened point 17 and the consequent deformation of the spacing members 13 inter-connecting the rings 12, until one or both portions **16*a* and 16*b* of each bridge member 16 is brought into contact against a ring member 12, thereby stopping it. In this state, shown in FIG. 4, the two portions 16*a* and 16*b* of each bridge member 16 act as a stop means for the ring members 12, so allowing control of the compression degree of the spool body and therefore the degree of packing of the yarn. Because the peripheral and longitudinal distribution of the stiffening bridge members 16**, and consequently of the compression stop means, is uniform over the spool both peripherally and longitudinally, the result is uniform and constant compression throughout the whole body of the spool.

The positioning and distribution of both the ring-connecting and spacing members 13 and the stiffening transverse bridge members 16 providing the compression degree, can be varied at will, and so may differ from that shown. For example, in the case shown in FIGS. 2 to 4 the bridge members 16 are positioned on opposite sides of a same ring member 12, and between contiguous ring members 12, at a regular interval on the circumference alternately to the spacing members 13 so as to provide in any case continuity to the spool structural rigidity; however, said stiffening and compression stop members 16 could be differently distributed and positioned; for example the two portions **16*a* and 16*b*** could have equal or different lengths to provide different areas of the spool body having different compression degree.

Figure 5:
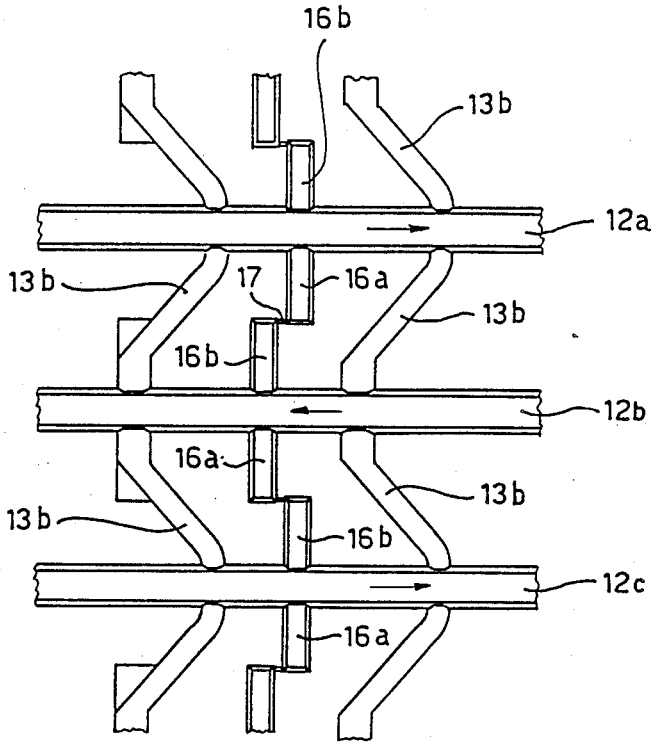
FIGS. 5 and 6 show front view of an enlarged detail of another embodiment with the spool in extended and compressed conditions.
Figure 6:
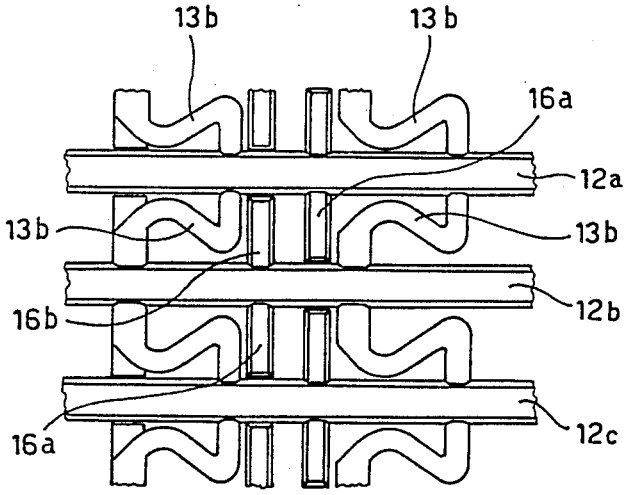

FIGS. 5 and 6 of the drawings show another embodiment of the spool according to the invention. In this case, too, the spool body comprises a plurality of intermediate ring members **12*a*, 12*b* and 12*c* joined by yieldable spacing members 13*b*, as in the previous case. Additionally, 16*a* and 16*b* again indicate the breakable portions of transverse stiffening members 16 joined at a weakened intermediate breaking point 17. However, unlike in the preceding FIGS. 2 and 4, the stiffening portions 16*a* and 16*b* in this case are positioned in an intermediate point between two contiguous spacing members 13*b*, said stiffening members 16*a*, 16*b* being provided on all the ring members 12 of the spool and the breaking points 17 being aligned along a straight line parallel to the spool's axis. When the spool is axially compressed, the inclined orientations of the yielding members 13*b* cause the rings 12*a* and 12*c* to rotate in a clockwise direction; and, the ring 12*b* rotates in a counterclockwise direction. FIG. 5 has arrows illustrating such rotation. To prevent interference between stiffening portions 16*a* and 16*b* after their respective breaking point 17 breaks, the interconnected stiffening portions 16*a* and 16*b* are circumferentially offset relative to each other in the directions their respective rings 12***a*, 12*b*, 12*c* tend to rotate.

What is claimed is:

1. A spool for winding yarn the spool having an axially compressible body comprising end annular members and a plurality of intermediate ring members, said annular members and said intermediate ring members being coaxially arranged and connected by yielding spacer members defining a winding surface for the yarn, said spacer members being peripherally arranged on the spool body, and comprising at least one inclined portion with respect to the longitudinal axis of the spool body; stiffening means being provided between contiguous intermediate ring members, said stiffening means comprising breakable members parallelly arranged to the longitudinal axis of the body of the spool, and stop means between contiguous ring members to limit the axial compression of the spool body, said stop means comprising apposite breakable portions of said stiffening members.

2. A spool as claimed in claim 1, in which said breakable members are recessed with respect to said yarn-winding surface.

3. A spool as claimed in claim 1, in which said breakable stiffening members are positioned close to said spacer members.

4. A spool as claimed in claim 1, in which said breakable members defining the stiffening and stop means comprise transverse bridge members having a lower bridge-portion and an upper bridge-portion, said upper and lower bridge-portion being laterally arranged and being joined at an intermediate breaking point.

5. A spool as claimed in claim 4, in which one of said bridge-portions is axially protruding from the stiffening member inter-connecting intermediate ring members of the spool.

6. A spool as claimed in previous claim 1, in which a first of said two portions of the stiffening members comprises a rounded outer edge to radially reduce the thickness of said first portion towards the second portion of said stiffening members.

7. A spool as claimed in claim 4, in which said two bridge-portions of the stiffening members are equal in length.

8. A spool as claimed in claim 4, in which said two bridge-portions are different in length.

9. A spool according to claim 1, in that said breakable stiffening and stop means are alternately arranged and disposed between said spacer members and said intermediate ring member of the body of the spool.

10. A spool as claimed in claim 1, in which said breakable stiffening members are located in an intermediate position between said spacer members.

11. A spool as claimed in claim 10, in which said breakable stiffening members have their breaking points aligned along a straight line parallel to the longitudinal axis of the spool.

12. A spool as claimed in claim 10 wherein, the inclined portions cause contiguous rings to rotate relative to each other during axial compression of the spool body, and said stiffening portions connected to a breaking point are circumferentially offset relative to each other in directions their respective rings rotate during axial compression, to prevent interference between the stiffening portions after their respective breaking point breaks.

* * * * *